US010494758B2

(12) United States Patent
Prajescu

(10) Patent No.: US 10,494,758 B2
(45) Date of Patent: Dec. 3, 2019

(54) DRYER APPLIANCES AND METHODS OF OPERATION

(71) Applicant: Haier US Appliance Solutions, Inc., Wilmington, DE (US)

(72) Inventor: Ionelia Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 69 days.

(21) Appl. No.: 15/815,808

(22) Filed: Nov. 17, 2017

(65) Prior Publication Data

US 2019/0153659 A1 May 23, 2019

(51) Int. Cl.
*D06F 58/28* (2006.01)
*D06F 58/22* (2006.01)
*D06F 58/06* (2006.01)

(52) U.S. Cl.
CPC ..... *D06F 58/28* (2013.01); *D06F 58/06* (2013.01); *D06F 58/22* (2013.01); *D06F 2058/2829* (2013.01)

(58) Field of Classification Search
CPC ..... D06F 58/28; D06F 58/06; D06F 58/22; D06F 2058/2829
USPC ..... 34/605
See application file for complete search history.

(56) References Cited

U.S. PATENT DOCUMENTS 3,060,593 A * 10/1962 Flora ..... D06F 58/08 310/61
4,663,861 A * 5/1987 Scriber ..... D06F 58/28 34/443
5,852,881 A * 12/1998 Kuroda ..... D06F 58/28 34/527
6,941,679 B1 * 9/2005 Harris ..... D06F 37/42 34/596
7,047,664 B1 5/2006 Martinez
7,073,273 B2 * 7/2006 Kim ..... D06F 58/20
8,528,229 B2 * 9/2013 Ashrafzadeh ..... D06F 58/04 34/560
9,009,987 B2 * 4/2015 Lee ..... F26B 21/06 34/443

(Continued)

FOREIGN PATENT DOCUMENTS

DE 102012200075 B3 * 2/2013 ..... A62C 3/00
EP 2787115 A3 * 3/2015 ..... D06F 58/04

(Continued)

*Primary Examiner* — Stephen M Gravini
(74) *Attorney, Agent, or Firm* — Dority & Manning, P.A.

(57) ABSTRACT

Dryer appliances, including methods of operation, are provided herein. The dryer appliance may include a cabinet, a drum, a ventilation assembly, an air handler, and a controller. The drum may be rotatably mounted within the cabinet. The drum may define a drying chamber. A ventilation assembly may be attached to the drying chamber. The ventilation assembly may include a conduit defining an exhaust passage in fluid communication with the drying chamber. The conduit may extend from an inlet at the drying chamber to an outlet defined through the cabinet. The air handler may be attached to the conduit in fluid communication with the drying chamber to draw air through the exhaust passage. The controller may be in operable communication with the air handler and the drum, and may be configured to initiate a dry cycle.

20 Claims, 5 Drawing Sheets

(56) References Cited

U.S. PATENT DOCUMENTS

| | | | | |
|---|---|---|---|---|
| 9,334,603 | B2 * | 5/2016 | Oak | D06F 58/28 |
| 9,567,704 | B2 * | 2/2017 | Ros | D06F 58/22 |
| 9,783,925 | B1 * | 10/2017 | Pollett | D06F 58/28 |
| 2008/0005926 | A1 | 1/2008 | Goggin | |
| 2009/0159301 | A1 * | 6/2009 | Chatot | D06F 58/20 169/56 |

FOREIGN PATENT DOCUMENTS

| | | | | |
|---|---|---|---|---|
| KR | 685965 | B1 | 2/2007 | |
| KR | 20140120980 | A * | 10/2014 | D06F 58/04 |

* cited by examiner

DRYER APPLIANCES AND METHODS OF OPERATION

FIELD OF THE INVENTION

The present subject matter relates generally to dryer appliances and more particularly to systems and methods for preventing restrictions within a dryer appliance.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, an air handler or blower is utilized to flow the internal air from the vent duct to the exhaust duct. When operating, the blower may pull air through itself from the vent duct, and this air may then flow from the blower to the exhaust conduit.

Although dryer appliances often include filter systems to prevent foreign materials, such as lint, from passing into the exhaust conduit, it is difficult for such systems to prevent all foreign materials from entering the exhaust. Although lint may be driven from the exhaust while the blower is operating, suspended lint may fall and rest within the exhaust once the blower ceases to operate. If permitted to accumulate within the exhaust conduit, such foreign materials may impair dryer performance. For instance, accumulated lint may restrict the effective operating size of the passages through which air flows during operation. Restrictions can prevent proper airflow, thereby hindering drying of articles in the dryer appliances.

In many existing systems, once foreign materials have accumulated within the exhaust, removal may be difficult and time consuming. Use of the dryer appliance must generally be halted as one more utensil is inserted into the exhaust conduit. Foreign materials often must be laboriously vacuumed or scraped out of the exhaust. Some foreign materials, including those around small or difficult to reach portions of the exhaust may even require a portion of the dryer appliance to be disassembled.

Accordingly, improved dryer appliances and methods for preventing restrictions within the dryer appliances are desired. In particular, dryer appliances and methods that prevent lint accumulation would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a dryer appliance is provided. The method may include directing rotation of the drum within the cabinet. The method may further include motivating a first airflow of internal air from the drying chamber to an outlet defined through a cabinet. The method may still further include halting rotation of the drum. The method may yet further include motivating a second airflow of internal air from the drying chamber to the outlet for a set time period in response to the halting rotation of the drum.

In another aspect of the present disclosure, a dryer appliance is provided. The dryer appliance may include a cabinet, a drum, a ventilation assembly, an air handler, and a controller. The drum may be rotatably mounted within the cabinet. The drum may define a drying chamber. A ventilation assembly may be attached to the drying chamber. The ventilation assembly may include a conduit defining an exhaust passage in fluid communication with the drying chamber. The conduit may extend from an inlet at the drying chamber to an outlet defined through the cabinet. The air handler may be attached to the conduit in fluid communication with the drying chamber to draw air through the exhaust passage. The controller may be in operable communication with the air handler and the drum. The controller may be configured to initiate a dry cycle. The dry cycle may include directing rotation of the drum within the cabinet, motivating a first airflow of internal air from the drying chamber to the outlet, halting rotation of the drum, and motivating a second airflow of internal air from the drying chamber to the outlet for a set time period in response to the halting rotation of the drum.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
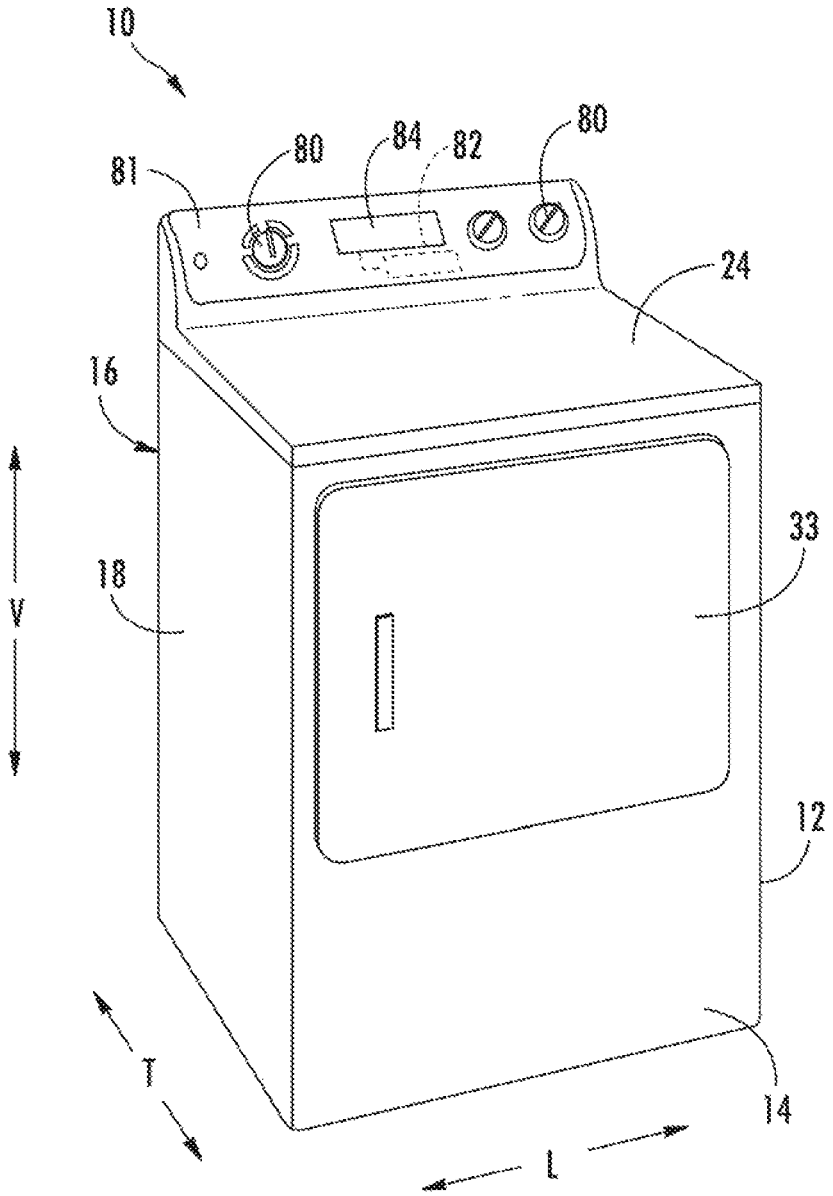
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
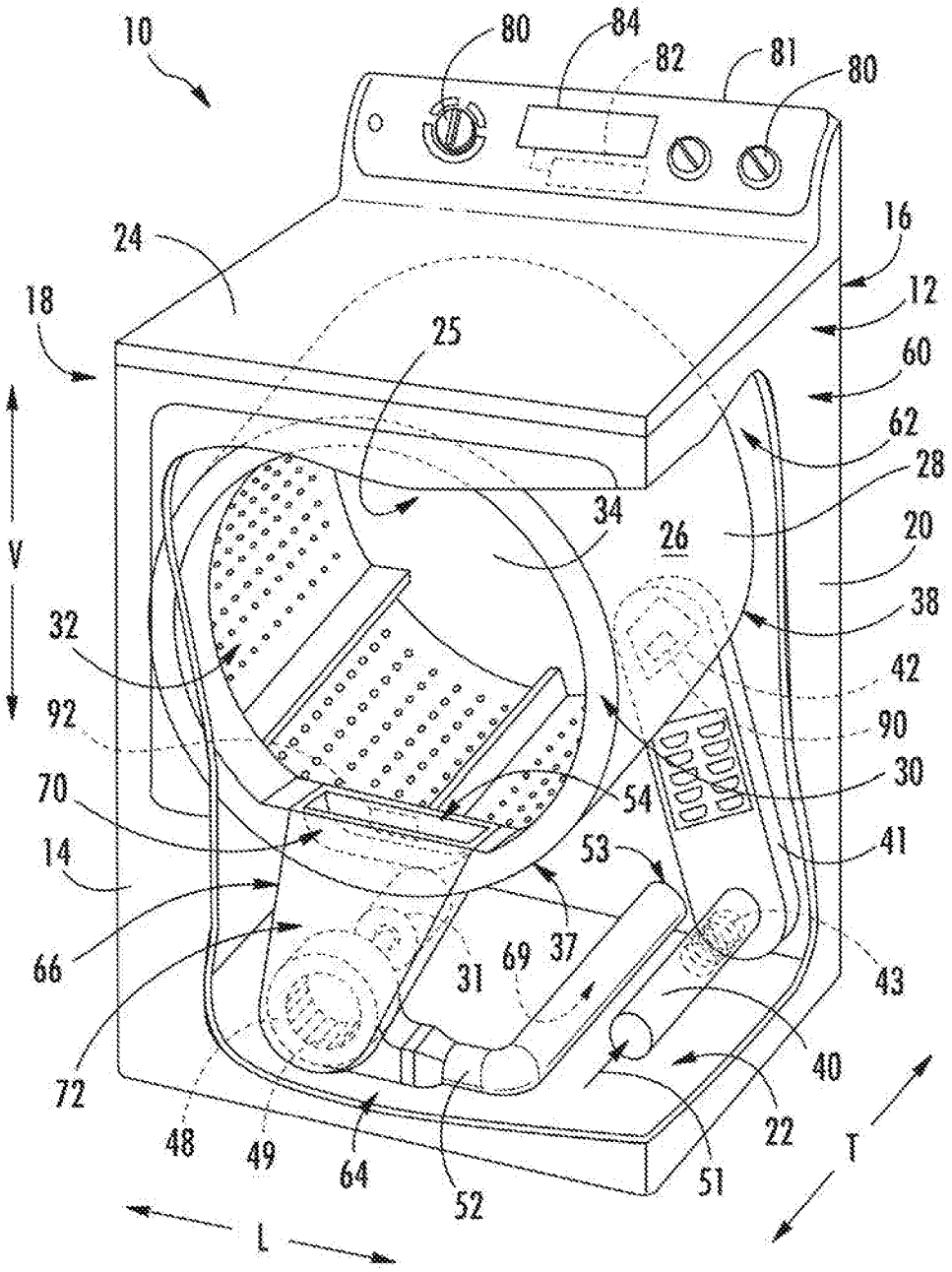
FIG. 2 provides a perspective view of the exemplary dryer appliance of FIG. 1, with portions of a cabinet of the dryer appliance removed to reveal certain components of the dryer appliance.
Figure 3:
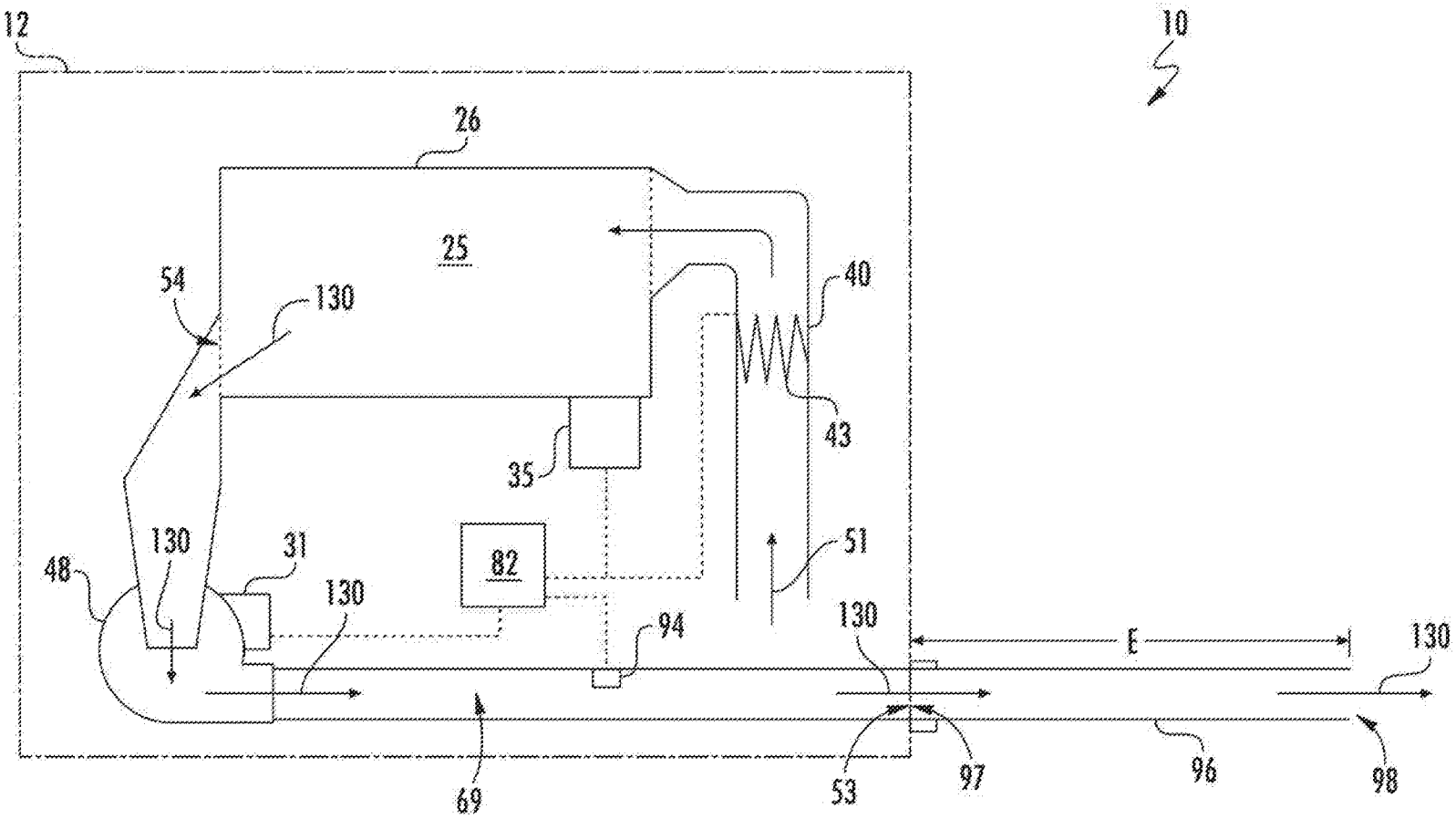
FIG. 3 provides a schematic view of various components of the exemplary dryer appliance of FIG. 2.

Turning now to the figures, FIG. 1 illustrates a dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. FIG. 3 provides a schematic view of dryer appliance 10. While described in the context of a specific embodiment of dryer appliance 10, using the teachings disclosed herein it will be understood that dryer appliance 10 is provided by way of example only. Other dryer appliances 10 having different appearances and different features may also be utilized with the present subject matter as well.

Generally, dryer appliance 10 defines a vertical direction V, a lateral direction L, and a transverse direction T. The vertical direction V, lateral direction L, and transverse direction T are mutually perpendicular and form and orthogonal direction system. Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a drum or container 26. Drum 26 defines a chamber 25 for receipt of articles (e.g., clothing, linen, etc.) for drying. Drum 26 extends between a front portion 37 and a back portion 38 (e.g., along the transverse direction T). In exemplary embodiments, drum 26 is rotatable, for instance, about an axis that is parallel to the transverse direction T, within cabinet 12.

A blower motor 31 may be in mechanical communication with an air handler (e.g., blower 48). During certain operations, motor 31 may rotate a blower fan or impeller 49 of blower 48. Blower 48 is configured for drawing air through chamber 25 of drum 26 (e.g., in order to dry articles located therein), as discussed in greater detail below. As illustrated in FIG. 3, dryer appliance 10 may include an additional motor (e.g., drum motor 35) in mechanical communication with drum 26. In turn, motor 35 may rotate drum independently of blower 48.

Drum 26 may be configured to receive heated air that has been heated by a heating assembly 40 (e.g., in order to dry damp articles disposed within chamber 25 of drum 26). Heating assembly 40 includes a heater 43, such as a gas burner or an electrical resistance heating element, for heating air. As discussed above, during operation of dryer appliance 10, motor 31 rotates impeller 49 of blower 48 such that blower 48 draws air through chamber 25 of drum 26. In particular, ambient air enters heating assembly 40 via an entrance (e.g., as indicated at arrow 51) due to blower 48 urging such ambient air into entrance. Such ambient air is heated within heating assembly 40 and exits heating assembly 40 as heated air. Blower 48 draws such heated air through inlet duct 41 to drum 26. The heated air enters drum 26 through an outlet 42 of duct 41. Outlet 42 may be positioned at rear wall 34 of drum 26.

Within chamber 25, the heated air can remove moisture (e.g., from damp articles disposed within chamber 25). This internal air, in turn, flows from chamber 25 through a ventilation assembly 64 positioned within interior 62. Generally, ventilation assembly 64 includes an exhaust conduit 52 that defines an exhaust passage 69. Exhaust passage 69 is in fluid communication with the drying chamber 25 and extends from an inlet 54 at drying chamber 25 to an outlet 53 defined by cabinet 12. In some embodiments, the exhaust conduit 52 includes a vent duct 66, blower 48, and a ducted conduit 68. As shown, exhaust conduit 52 may be configured in fluid communication with vent duct 66 via blower 48. During a dry cycle, internal air (e.g., airflow at 130) flows from chamber 25 through vent duct 66 to blower 48 and through blower 48 to exhaust conduit 52. The internal air is then exhausted from dryer appliance 10 via the outlet 53.

In some embodiments, an external duct 96 is provided in fluid communication with exhaust conduit 52. For instance, external duct 96 may be attached (e.g., directly or indirectly attached) to cabinet 12 at rear panel 16. Any suitable connector (e.g., collar, clamp, etc.) may join external duct 96 to exhaust conduit 52. In turn, external duct 96 may be downstream from outlet 42. Generally, external duct 96 may define a length E that extends between a duct inlet 97 and a duct outlet 98. When assembled, duct inlet 97 is positioned proximate to cabinet 12 and outlet 42 while duct outlet 98 is positioned distal to cabinet 12. In residential environments, duct outlet 98 may be positioned at or in communication with an outdoor environment (e.g., outside of a home or building in which dryer appliance 10 is installed). During a dry cycle, internal air (e.g., airflow at 130) may thus flow from exhaust conduit 52 to duct inlet 97; and from duct inlet 97 to duct outlet 98 along the length E, before being exhausted to the outdoor environment.

In exemplary embodiments, vent duct 66 may include a filter portion 70 and an exhaust portion 72. Exhaust portion 72 may be positioned downstream of filter portion 70 (in the direction of flow of the internal air). A screen filter of filter portion 70 (which may be removable) traps lint and other foreign materials as the internal air flows therethrough. The internal air may then flow through exhaust portion 72 and blower 48 to ducted conduit 68 and, subsequently, external duct 96. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motors 31 and 35 and heating assembly 40 (including heater 43) in response to the position of selector inputs 80. Additionally, a display 84, such as an indicator light or a screen, may be provided on cabinet backsplash 81. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitive storage media) such as, for example, electrically erasable, programmable read only memory (EEPROM). The memory elements can store information accessible processing device, including instructions that can be executed by processing device. For example, the instructions can be software or any set of instructions that when executed by the processing device, cause the processing device to perform operations. For certain embodiments, the instructions include a software package configured to operate appliance 10 and, for instance, execute the exemplary methods 400 and 500 described below with reference to FIGS. 4 and 5.

In some embodiments, dryer appliance 10 includes one or more temperature sensors (e.g., temperature sensor 90). Temperature sensor 90 is operable to measure internal temperatures in dryer appliance 10. In particular, temperature sensor 90 may be provided as any suitable temperature sensor (e.g., thermistor, thermocouple, etc.) in communication (e.g., electrical communication or wireless communication) with controller 82, and may transmit readings or signals to controller 82 as required or desired. In some embodiments, for example, temperature sensor 90 may be disposed in inlet duct 41, such as at outlet 42 of inlet duct 41, which corresponds to an inlet to drum 26. Additionally or alternatively, for example, temperature sensor 90 may be disposed in drum 26, such as in chamber 25 thereof, at an outlet of drum 26 such as in vent duct 66, or in any other suitable location within dryer appliance 10.

In additional or alternative embodiments, dryer appliance 10 includes one or more dampness or moisture sensors (e.g., moisture sensor 92). Moisture sensor 92 is operable to measure the dampness or moisture content of articles within chamber 25 during operation of dryer appliance 10. In particular, moisture sensor 92 may be provided as any suitable moisture sensor (e.g., capacitive moisture sensor, resistive moisture sensor, etc.) in communication (e.g., electrical communication or wireless communication) with controller 82, and may transmit readings or signals to controller 82 as required or desired. Moisture sensor 92 may measure voltages associated with dampness or moisture content within the clothing, as is generally understood. In FIG. 2, moisture sensor 92 is shown disposed on wall 30 proximate filter portion 70. In alternative exemplary embodiments, moisture sensor 92 may be disposed at any other suitable location within dryer appliance 10 (e.g., on cylinder 28, rear wall 34, etc.). Moisture sensor 92 may be any suitable moisture sensor (e.g., in communication with controller 82), and may transmit readings to controller 82 as required or desired.

In further additional or alternative embodiments, dryer appliance 10 includes one or more flow sensors (e.g., flow sensor 94). Flow sensor 94 is generally operable to measure airflow velocity (e.g., in feet per minute) through a portion of appliance 10, such as ventilation assembly 64. In particular, flow sensor 94 may be provided as any suitable flow sensor 94 (e.g., mechanical flow meter, pressure-based meter, optical meter, etc.) in communication (e.g., electrical communication or wireless communication) with controller 82, and may transmit readings or signals to controller 82 as required or desired. In certain embodiments, flow sensor 94 is disposed in exhaust conduit 52 (e.g., along exhaust passage 69). Additionally or alternatively, flow sensor(s) may be disposed in any other suitable location within dryer appliance 10.

During certain operations, such as a dry cycle, flow sensor 94 may measure a separate first airflow and second airflow through ventilation assembly 64. As used within the present disclosure, "first airflow" and "second airflow" are used in order to distinguish a temporal relationship (as opposed to a positional relationship). Thus, the first airflow and the second airflow may be distinguished by a delineating occurrence or action. For instance, the first airflow may be understood to indicate an airflow (e.g., as shown at airflow 130) during rotation of drum 26; and the second airflow may be understood to indicate a subsequent or later airflow (e.g., as also shown at airflow 130). In some embodiments, the first and second airflows are delineated by a change in the rotation of drum 26. For instance, the second airflow may begin after a halting of rotation of drum 26 (e.g., following deactivation of motor 31). Flow sensor 94 may thus be positioned downstream from drying chamber 25 to measure the first airflow at a time before the second airflow.

Figure 4:
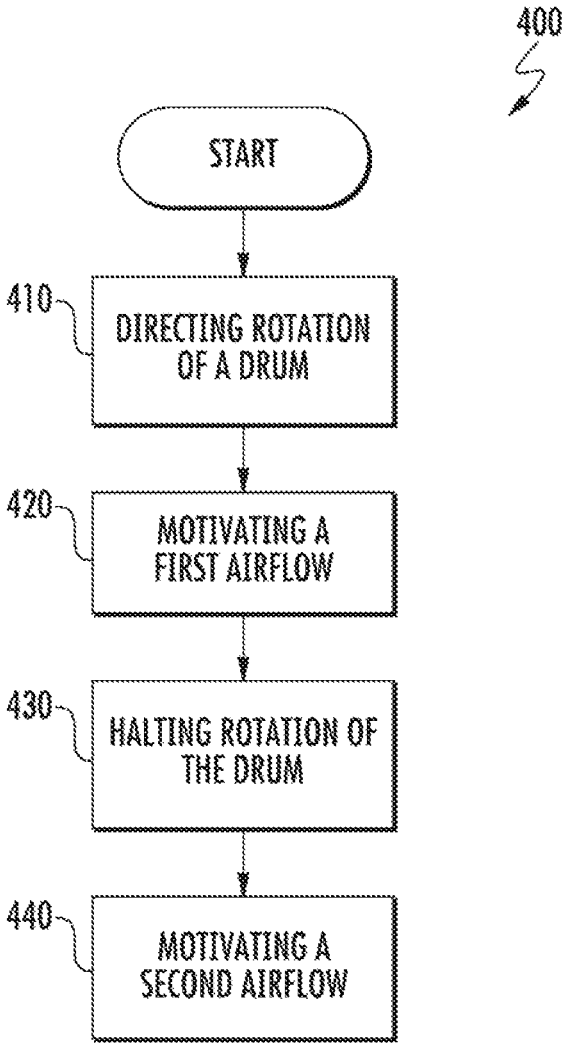
FIG. 4 provides a flow chart illustrating a method of operating a dryer appliance in accordance with exemplary embodiments of the present disclosure.
Figure 5:
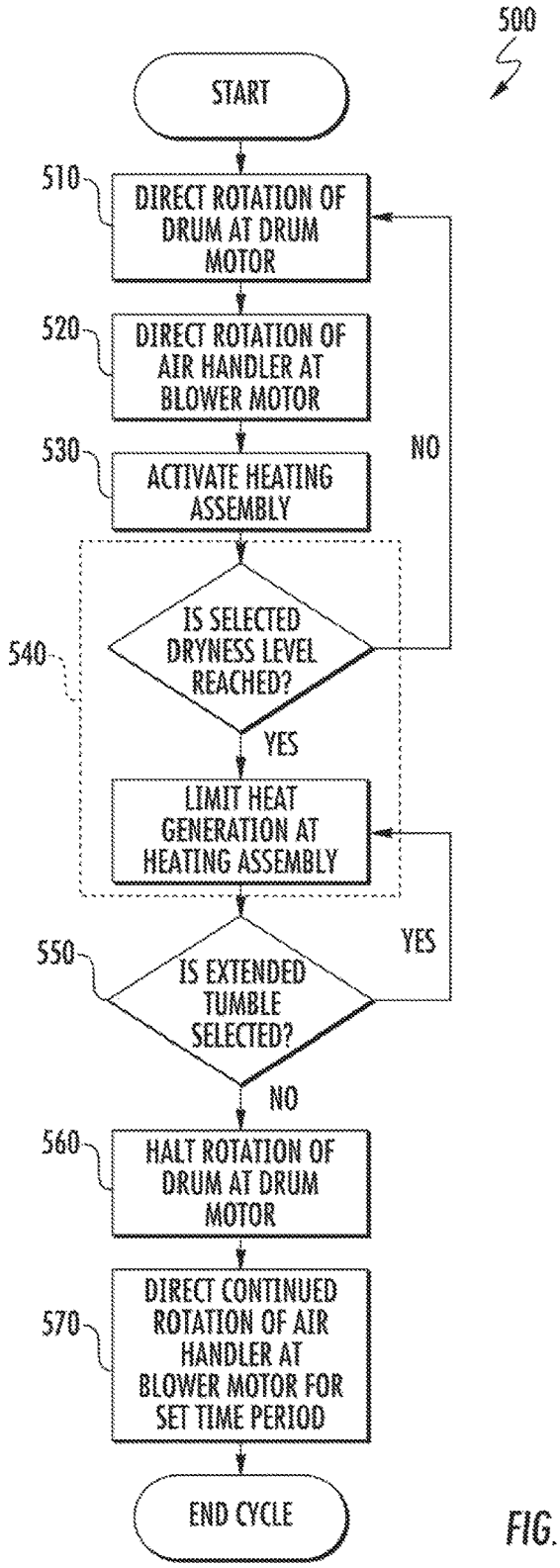
FIG. 5 provides a flow chart illustrating a method of operating a dryer appliance in accordance with exemplary embodiments of the present disclosure.

Turning now to FIGS. 4 and 5, flow diagrams are provided of various methods (e.g., method 400 and method 500) according to exemplary embodiments of the present disclosure. Generally, the methods 400, 500 provide for preventing a restriction (e.g., lint) from forming within an exhaust passage 69 in a dryer appliance 10, as described above. The methods 400 and 500 can be performed, for instance, by the controller 82. For example, controller 82 may, as discussed, be in communication with the sensors 90 through 94, motors 31 and 35, heating assembly 40; and may send signals to and receive signals from sensors (e.g., sensors 90 through 94), motors (e.g., motors 31 and 35), and heating assembly 40. Controller 82 may further be in communication with other suitable components of the appliance 10 to facilitate operation of the appliance 10 generally. FIGS. 4 and 5 depict steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways (except as otherwise indicated) without deviating from the scope of the present disclosure.

Referring now to FIG. 4, at 410, the method 400 includes directing rotation of the drum within the cabinet. In particular, the drum motor may motivate the drum to rotate about its axis of rotation. In turn, articles within the drying chamber may be lifted and tumbled, for instance, as part of a dry cycle.

At 420, the method 400 includes motivating a first airflow of internal air from the drying chamber to an outlet defined through the cabinet. As discussed above, the blower motor may motivate the first airflow such that air flows through the heating assembly before flowing through the drum and ventilation assembly. From the ventilation assembly, the first airflow may further flow through the length of the external duct (e.g., such that air is exhausted to the outdoor environment). The first airflow of 420 may be provided at a predetermined speed setting. Thus, the blower motor may be rotated at a certain torque or rotational velocity that has been determined to provide a corresponding velocity of air (e.g., in feet per minute) through ventilation assembly or external duct. For instance, the speed setting for the first airflow may be a value at or above (i.e., equal to or greater than) 1200 feet per minute (FPM).

In some embodiments, or during certain user-selected cycles, the heating assembly may be activated to heat the first airflow during 420. Thus, air entering the drying chamber may be provided at an elevated temperature (e.g., to dry articles within the drum) before flowing into the ventilation assembly as part of the first airflow. Moreover, at least a portion of 420 may be performed simultaneous to 410. Thus, at least a portion of the first airflow at 420 is motivated as the drum rotates at 410.

At 430, the method 400 includes halting rotation of the drum. In other words, 430 ends the rotation initiated at 410.

For instance, the drum motor may be deactivated such that rotation of the drum is hindered and ultimately stopped by the counteracting forces of friction and gravity. Additionally or alternatively, a clutch system may be provided to mechanically decouple a motor from the drum. In such embodiments, 430 may include decoupling the motor from the drum. Thus, the drum motor will cease to direct or drive rotation of the drum. Optionally, 430 may further provide for deactivation of the heating assembly. In turn, the heating element of the heating assembly will not (e.g., no longer) supply thermal energy to the air entering the drying chamber.

In some embodiments, 430 is initiated in response to expiration of a predetermined dry time. For instance, the predetermined dry time may be a user-specified time for which the drum will rotate (e.g., at 410) or heating assembly will remain active to supply heat to the drying chamber. In other embodiments, 430 is initiated in response to a determination that a desired dryness level is reached. Such a determination may be made, for instance, based on one or more signals received from the moisture signal during rotation of the drum at 410.

At 440, the method 400 may include motivating a second airflow of internal air from the drying chamber to the outlet. In some such embodiments, the second airflow of 440 is motivated or flowed for a set time period. Generally, 440 is performed in response to the halting rotation of the drum. As described above, the second airflow follows the same positional path as the first airflow. Blower motor may thus motivate the second airflow such that air flows through the drum and ventilation assembly before flowing through the length of the external duct (e.g., such that air is exhausted to the outdoor environment). The first and second airflows may be delineated or defined by 430 (e.g., deactivation of the drum motor). The first airflow may thus be defined as ending when the drum motor is deactivated, while the second airflow is defined as beginning when the drum motor is deactivated. The second airflow may further end at the expiration of the set time period. In some embodiments, air is flowed continuously from 420 through 440. Thus, the second airflow may be temporally continuous with the first airflow. Advantageously, suspended foreign objects (e.g., lint) may be prevented from resting and accumulating (e.g., within ventilation assembly or external duct) after the drum is no longer rotating.

In some embodiments, the second airflow of 440 may be provided at a predetermined or variable speed setting. Thus, the blower motor may be rotated at a certain torque or rotational velocity that has been determined to provide one or more corresponding velocities of air (e.g., in feet per minute) through ventilation assembly or external duct. For instance, the predetermined speed setting for the second airflow may be a value at or above (i.e., equal to or greater than) 1200 feet per minute (FPM). Additionally or alternatively, the speed setting for the second airflow may be the same as the first airflow. Thus, the second airflow may continue from the first airflow at the same speed. Additionally or alternatively, the speed setting of the second airflow may be varied (e.g., increased) upon initiation of 440, as will be further described below.

In certain embodiments, the set time period of 440 is a predetermined period of time. For instance, the predetermined period may be greater than or equal to 1 second. Optionally, the predetermined period may be greater 10 seconds (e.g., between 10 seconds and 30 seconds). Moreover, the predetermined period may be greater than 25 seconds (e.g., between 25 and 35 seconds). Additionally or alternatively, the predetermined period may be greater than 50 seconds (e.g., between 50 and 60 seconds). In certain embodiments, the method 400 includes determining the set time period as a function of the duct length (e.g., in feet) over a speed setting (e.g., in feet per minute) of the second airflow. For instance, the set time period may be calculated according to the equation:

$$t=(E_d/v)$$

wherein t is the set time period;

wherein $E_d$ is the duct length; and wherein v is the speed setting of the second airflow.

In some embodiments, the velocity of the second airflow (e.g., through ventilation assembly) is determined prior to or in response to initiation of 440 (e.g., prior to expiration of the set time period). As an example, the method 400 may include receiving an air velocity signal from the flow sensor (e.g., upon halting drum rotation at 430) and calculating the velocity of the second airflow based on this received velocity signal. As another example, the method 400 may include receiving a torque signal from the air handler (e.g., at the blower motor) and calculating the velocity of the second airflow based on this received torque signal. In embodiments wherein the velocity of the first airflow is equal to the velocity of the second airflow, the velocity signal or torque may be received during 420 to determine the velocity of the first airflow (and thereby the second airflow) based on this received signal.

After the velocity of the second airflow is determined, the set time period may be calculated or recalculated using the velocity of the second airflow. In particular, the set time period may be calculated as a function of the duct length (e.g., in feet) over the velocity (e.g., in feet per minute) of the second airflow.

As noted above, in some embodiments, the speed setting of the second airflow is variable. Thus, the velocity (i.e., air velocity) of the second airflow may be increased or otherwise altered in response to certain conditions.

As an example, the velocity of the second airflow may be increased in response to a restriction within ventilation assembly or external duct. In some such embodiments, the method 400 includes determining whether a flow restriction is present downstream from the drying chamber. For instance, during one or both of 410 and 420, the controller may monitor temperature signals received from a temperature sensor (e.g., at the drum inlet). If a detected temperature or rate of temperature increase exceeds a predetermined threshold, the controller may determine that the flow restriction is present (e.g., such that the first airflow is hindered). In response to such a determination, the speed setting and velocity of the second airflow at 440 may be increased to a value above that of the first airflow. Thus, the second airflow may be faster than the first airflow when a flow restriction is detected. By contrast, if no flow restriction is detected, the speed setting and velocity of the second airflow at 440 may be maintained at a value that is equal to that of the first airflow.

As another example, the velocity of the second airflow may be increased in response to a determination that the velocity of the first airflow is below a minimum air velocity. In some such embodiments, the method 400 includes determining whether the minimum air velocity is met downstream from the drying chamber (e.g., through the ventilation assembly). For instance, during one or both of 410 and 420, the controller may monitor flow signals received from the flow sensor within the exhaust passage. If the controller determines that the minimum air velocity is not met or exceeded, the speed setting and velocity of the second airflow at 440 may be increased to a value above that of the first airflow. Thus, the second airflow may be faster than the first airflow after the first airflow fails to reach the minimum air velocity. By contrast, if the first airflow meets or exceeds the minimum air velocity, the speed setting and velocity of the second airflow at 440 may be maintained at a value that is equal to that of the first airflow.

Turning now to FIG. 5, a flow chart illustrating the exemplary method 500 is provided. Although described independently of method 400, it is understood that the method 500 may be included with or separate from the method 400. In other words, the method 500 may include one or more steps of the method 400, and vice versa.

At 510, the method 500 includes directing rotation of the drum within the cabinet. In particular, the drum motor motivates the drum to rotate about its axis of rotation. In turn, articles within the drying chamber may be lifted and tumbled, for instance, as part of a dry cycle.

At 520, the method 500 includes directing rotation of the air handler at the blower motor. Thus, the air handler may motivate a first airflow of internal air from the drying chamber to an outlet defined through the cabinet. As discussed above, the blower motor motivates the first airflow such that air flows through the heating assembly before flowing through the drum and ventilation assembly. From the ventilation assembly, the first airflow may further flow through the length of the external duct (e.g., such that air is exhausted to the outdoor environment). The first airflow of 520 may be provided at a predetermined speed setting. Thus, the blower motor may be rotated at a certain torque or rotational velocity that has been determined to provide a corresponding velocity of air (e.g., in feet per minute) through ventilation assembly or external duct. For instance, the speed setting for the first airflow may be a value at or above (i.e., equal to or greater than) 1200 feet per minute (FPM).

At 530, the method 500 includes activating the heating assembly. As discussed above, one or more heating elements may thus be activated or energized to heat air flowing through the heating assembly and to the drying chamber. In some embodiments, 530 occurs during at least a portion of 510 and 520. In turn, the air being motived by the air handler as the drum rotates will be heated by the heating assembly (e.g., to dry articles within the drum) before flowing into the ventilation assembly as part of the first airflow.

At 540, the method 500 includes evaluating the dryness of articles within the drum. For example, the controller may receive one or more signals from the moisture sensor during at least a portion of 510 and 540. From the received signals, the controller may determine the dampness or moisture content of the articles and compare the moisture content to a selected dryness level (e.g., a predetermined limit). If the selected dryness level is reached, the method 500 may continue with or repeat 510 through 540. If the selected dryness level is reached, the controller may limit (e.g., deactivate or otherwise reduce) the heat generated at the heating assembly as the drum continues to rotate and the air handler continues to motivate the first airflow.

At 550, the method 500 includes performing any selected extended tumble cycle (e.g., in response to 540). If an extended tumble cycle has been selected (e.g., as commanded or input by a user), the drum may continue to rotate as the first airflow continues. Such extended tumble cycles may prevent articles within the drum from resting or wrinkling, as would be understood by one of ordinary skill in the art. Upon completion or expiration of the extended tumble cycle, the method 500 may proceed to 560. If no extended tumble cycle is selected, the method 500 may proceed (e.g., directly) from 540 to 560.

At 560, the method 500 includes halting rotation of the drum. In other words, 560 ends the rotation initiated at 510. For instance, the drum motor may be deactivated such that rotation of the drum is hindered and ultimately stopped by the counteracting forces of friction and gravity.

At 570, the method 500 includes directing continued rotation of the air handler at the blower motor for a set time period. Generally, 570 is performed in response to the halting rotation of the drum at 560. Thus, the air handler may motivate a second airflow of internal air from the drying chamber to the outlet for the set time period (e.g., at the same air speed setting and velocity of the first airflow). As described above, the second airflow follows the same positional path as the first airflow. Blower motor may thus motivate the second airflow such that air flows through the drum and ventilation assembly before flowing through the length of the external duct (e.g., such that air is exhausted to the outdoor environment). As discussed above, the set time period may be a predetermined period, which ends the second airflow at the completion or expiration of the predetermined time period.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dryer appliance comprising a cabinet, a drum defining a drying chamber within the cabinet, a ventilation assembly in fluid communication with the drying chamber, and an air handler mounted along the ventilation assembly, the method comprising:

directing rotation of the drum within the cabinet;

motivating a first airflow of internal air from the drying chamber to an outlet defined through the cabinet;

halting rotation of the drum; and motivating a second airflow of internal air from the drying chamber to the outlet for a set time period in response to the halting rotation of the drum, wherein motivating the first airflow comprises directing rotation of the air handler to draw the first airflow through the air handler between the drying chamber and the outlet, and wherein motivating the second airflow comprises directing rotation of the air handler to draw the second airflow through the air handler between the drying chamber and the outlet.

2. The method of claim 1, further comprising determining the set time period as a function of a duct length downstream from the outlet over a speed setting of the second airflow.

3. The method of claim 1, wherein the set time period is greater than or equal to ten seconds.

4. The method of claim 1, wherein the first airflow has an air speed setting that is greater than or equal to an air speed setting of the second airflow.

5. The method of claim 1, wherein the second airflow is motivated at a predetermined speed setting.

6. The method of claim 1, further comprising determining a velocity of the second airflow prior to expiration of the set time period.

7. The method of claim 6, wherein the determining the velocity of the second airflow comprises receiving a torque signal from an air handler, and calculating the velocity of the second airflow based on the received torque signal.

8. The method of claim 6, wherein the determining the velocity of the second airflow comprises receiving an air velocity signal from a flow sensor positioned within the ventilation assembly, and calculating the velocity of the second airflow based on the received air velocity signal.

9. The method of claim 1, further comprising determining whether a flow restriction is present downstream from the drying chamber; and increasing an air velocity of the second airflow above an air velocity of the first airflow in response to determining the flow restriction is present.

10. The method of claim 1, further comprising determining whether a minimum air velocity is met through the ventilation assembly prior to the halting rotation of the drum; and increasing a velocity of the second airflow above a velocity of the first airflow in response to determining the minimum air velocity is not met.

11. A dryer appliance, comprising:

a cabinet;

a drum rotatably mounted within the cabinet, the drum defining a drying chamber;

a ventilation assembly attached to the drying chamber, the ventilation assembly comprising a conduit defining an exhaust passage in fluid communication with the drying chamber, the conduit extending from an inlet at the drying chamber to an outlet defined through the cabinet;

an air handler attached to the conduit in fluid communication with the drying chamber to draw air through the exhaust passage; and a controller in operable communication with the air handler and the drum, the controller being configured to initiate a dry cycle, the dry cycle comprising directing rotation of the drum within the cabinet, motivating a first airflow of internal air from the drying chamber to the outlet, halting rotation of the drum, and motivating a second airflow of internal air from the drying chamber to the outlet for a set time period in response to the halting rotation of the drum, wherein motivating the first airflow comprises directing rotation of the air handler to draw the first airflow through the air handler between the drying chamber and the outlet, and wherein motivating the second airflow comprises directing rotation of the air handler to draw the second airflow through the air handler between the drying chamber and the outlet.

12. The dryer appliance of claim 11, wherein the dry cycle further comprises determining the set time period as a function of a duct length downstream from the outlet over a speed setting of the second airflow.

13. The dryer appliance of claim 11, wherein the set time period is greater than or equal to ten seconds.

14. The dryer appliance of claim 11, wherein the first airflow has an air speed setting that is greater than or equal to an air speed setting of the second airflow.

15. The dryer appliance of claim 11, wherein the second airflow is motivated at a predetermined speed setting of the air handler.

16. The dryer appliance of claim 11, wherein the dry cycle further comprises determining a velocity of the second airflow prior to expiration of the set time period.

17. The dryer appliance of claim 16, wherein the determining the velocity of the second airflow comprises receiving a torque signal from an air handler, and calculating the velocity of the second airflow based on the received torque signal.

18. The dryer appliance of claim 16, further comprising a flow sensor positioned within the exhaust passage, wherein the determining the velocity of the second airflow comprises receiving an air velocity signal from the flow sensor, and calculating the velocity of the second airflow based on the received air velocity signal.

19. The dryer appliance of claim 11, wherein the dry cycle further comprises determining whether a flow restriction is present downstream within the exhaust passage, and increasing an air velocity of the second airflow above an air velocity of the first airflow in response to determining the flow restriction is present.

20. The dryer appliance of claim 11, wherein the dry cycle further comprises determining whether a minimum air velocity is met through the exhaust passage prior to the halting rotation of the drum, and increasing a velocity of the second airflow above a velocity of the first airflow in response to determining the minimum air velocity is not met.

* * * * *